US011158135B2

(12) United States Patent
Miller

(10) Patent No.: US 11,158,135 B2
(45) Date of Patent: Oct. 26, 2021

(54) DISPENSING APPARATUS FOR DISPENSING CARD-SHAPED DATA CARRIERS

(71) Applicant: Scheidt & Bachmann USA, Inc., Lowell, MA (US)

(72) Inventor: Norbert Miller, Mönchengladbach (DE)

(73) Assignee: Scheidt & Bachmann USA, Inc., Lowell, MA (US)

( * ) Notice: Subject to any disclaimer, the term of this patent is extended or adjusted under 35 U.S.C. 154(b) by 321 days.

(21) Appl. No.: 16/395,795

(22) Filed: Apr. 26, 2019

(65) Prior Publication Data

US 2020/0342689 A1 Oct. 29, 2020

(51) Int. Cl.

| | |
|---|---|
| ***G07B 3/04*** | (2006.01) |
| ***G07B 5/08*** | (2006.01) |
| ***G07F 17/42*** | (2006.01) |

(52) U.S. Cl.

CPC ..... *G07B 3/04* (2013.01); *G07B 5/08* (2013.01); *G07F 17/42* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,851,651 | A * | 7/1989 | Gaucher | G06K 17/00 235/380 |
| 5,421,463 | A * | 6/1995 | Okazaki | B65H 29/62 209/559 |
| 2018/0001673 | A1 | 1/2018 | Takeshita et al. | |
| 2018/0082512 | A1* | 3/2018 | Willis | G07F 19/21 |

FOREIGN PATENT DOCUMENTS

| | | |
|---|---|---|
| EP | 0 987 659 A1 | 3/2000 |
| EP | 3 296 971 A1 | 3/2018 |

* cited by examiner

*Primary Examiner* — Kyle O Logan
(74) *Attorney, Agent, or Firm* — Sunstein LLP

(57) ABSTRACT

A dispensing apparatus for dispensing card-shaped data carriers, includes at least one coding unit configured to encode a data carrier with at least one data set, and at least one detection unit configured to detect the functionality of the encoded data carrier. The dispensing apparatus further includes at least one sorting unit having at least one drive means configured to forward the data carrier, wherein the drive means is configured such that the data carrier is forwarded with a first speed upon detection of an error-free data carrier, and the data carrier is forwarded with a second speed upon detection of a defective data carrier, the first speed being different from the second speed.

11 Claims, 5 Drawing Sheets

DISPENSING APPARATUS FOR DISPENSING CARD-SHAPED DATA CARRIERS

TECHNICAL FIELD

The application relates to a dispensing apparatus for dispensing card-shaped data carriers, comprising at least one coding unit configured to encode a card-shaped data carrier with at least one data set, and at least one detection unit configured to detect the functionality of the encoded data carrier. In addition, the application relates to a dispensing device and a method for operating a dispensing apparatus.

BACKGROUND ART

A dispensing device comprises at least one dispensing apparatus for dispensing card-shaped data carriers. A dispensing device in accordance with the present application may be formed as a self-service terminal for customers, as a vendor-operated terminal or as a machine within a (partially) automated process, e.g. for the production, control and further handling of card-shaped data carriers. In particular, a dispensing device can be a kiosk for dispensing card-shaped data carriers, such as a ticket vending machine.

From prior art dispensing apparatuses are known in which a data carrier to be dispensed is first encoded with a data set. A coding unit may be provided for this purpose. After encoding the data carrier, the functionality of this data carrier can be checked by a detection unit. The data carrier is then forwarded by a drive means to a sorting unit.

Known sorting units can, for example, have a controllable switch mechanism. The switch mechanism is configured to transport a data carrier along a first conveyor line or along a second conveyor line depending on the result of the function check. Thus a first switch position is set in order to transport an error-free data carrier along a first conveyor line. Via the first conveyor line, the error-free data carrier can be conveyed, for example, to a first receptacle from which the data carrier can be fed to a downstream process for further processing of "OK" tested data carriers, e.g. the data carrier can be packed for dispatch or made available to a customer for receptacle. A second switch position is set to transport a defective data carrier along a second conveyor line. Via the second conveyor line, the defective data carrier can, for example, be conveyed to a second receptacle in which defective data carriers can be temporarily collected.

However, such a sorting unit with at least two conveyor lines requires a considerable amount of space. In addition, the design of a controllable switch mechanism (for example a flap mechanism) is complex and prone to failure, particularly due to the plurality of moving parts. The complexity is further increased as the switch mechanism and the at least two conveyor lines have to be structurally adapted to the other components of a dispensing device. In particular, the space available for the switch mechanism and the at least two conveyor lines may be small and/or have unfavorable proportions/dimensions. Due to the complexity of the known sorting units, errors can occur during operation.

Also known as sorting units are gripping mechanisms, which have similar disadvantages as a switch mechanism.

Therefore, the object of the present application is to provide a dispensing apparatus for dispensing card-shaped data carriers, which enables sorting of data carriers with a simpler mechanism and, in particular, ensures a reliable operation.

SUMMARY OF THE INVENTION

According to a first aspect of the invention, a dispensing apparatus is, in particular, configured to dispense card-shaped data carriers. The dispensing apparatus comprises at least one coding unit. The coding unit is configured to encode a data carrier with at least one data set. The dispensing apparatus comprises at least one detection unit. The detection unit is configured to detect the functionality of the encoded data carrier. The dispensing apparatus comprises at least one sorting unit with at least one drive means. The drive means is configured to forward the data carrier. Upon detection of an error-free data carrier, the drive means is configured in such a way that the data carrier is forwarded with a first speed. Upon detection of a defective data carrier, the drive means is configured in such a way that the data carrier is forwarded with a second speed. The first speed is different from the second speed.

In contrast to the prior art, in accordance with the present application, a drive means operable at at least two different speed levels is provided for sorting the card-shaped data carriers, thus enabling data carriers to be sorted using a simple mechanism. In particular, reliable operation of the dispensing apparatus is ensured. A switch mechanism can be omitted as well as the at least two conveyor lines downstream of a switch mechanism. The installation space required for a sorting unit in a dispensing device (e.g. ticket vending machine) can be significantly reduced.

The dispensing apparatus can dispense card-shaped data carriers. Preferably such a data carrier can be made of a plastic material. It goes without saying that a data carrier can also be made up of other materials.

The card-shaped data carrier may comprise at least one encodable and readable memory module. For example, the data carrier may comprise a built-in integrated circuit (chip) that includes hardware logic, memory, or even a microprocessor. At least the memory of the data carrier can be read via a suitable wireless interface. Alternatively or additionally, at least one contact-based interface can be provided.

The card-shaped data carrier may preferably be formed in accordance with the specifications of the ISO 7810 standard. It shall be understood that according to other variants of the application, a card-shaped data carrier may have different dimensions. The card-shaped data carrier may be made of paper, plastic or composite materials. The card-shaped data carrier can comprise a thickness of 0.2 to 0.9 mm, preferably a thickness of 0.7 to 0.9 mm (so-called thick plastic card). The card-shaped data carrier may also have a length of 85.6 mm and a width of 53.98 mm (ID-1 card according to ISO 7810).

The card-shaped data carrier can be an ID00 card, Mini UIC card and/or ID000 card or carrier of such a card, for example the data carrier can carry a SIM card, Mini-SIM card or Micro-SIM card.

The card-shaped data carrier comprises at least one data memory and at least one data interface. The data interface can be contactless according to ISO 14443, ISO 15639 or similar. The data interface can be contact-based according to ISO 7816 or similar. The data interface can comprise the data memory, which is the case, for example, if the data carrier is equipped with a magnetic stripe.

According to the application, at least one coding unit is provided. The coding unit is configured to encode or write a data set to the card-shaped data carrier. In particular, the coding unit may include a coding module configured to generate a coding signal in accordance with a data set provided. The coding signal can be transmitted to the data carrier via an interface (e.g. a contactless or a contact-based interface) of the coding unit so that the data set is stored into the memory module of the data carrier. The interface of the coding unit corresponds in particular to the at least one interface of the data carrier.

The at least one data set may comprise data necessary for the intended use of the data carrier or data not suitable for the use of the data carrier (for example: test data).

The dispensing apparatus also comprises a detection unit. The detection unit is configured to detect the functionality of the encoded card-shaped data carrier. This includes, in particular, checking the functionality of the encoded data carrier. Preferably, the detection unit can perform at least one functional test. For example, the detection unit can check whether at least some of the data on the data carrier stored in the memory module can be read (without errors). For example, the detection unit can write the data to the data carrier via an interface (contact-based or contactless) and then read the stored data back from the data carrier; an error-free storage is detected, in particular, if the detection unit reads back the same data as it has previously written to the data carrier. The interface of the detection unit corresponds in particular to the at least one interface of the data carrier. Preferably, the interface of the detection unit may be formed by the interface of the coding unit.

If the dispensing apparatus according to the present invention is executed for card-shaped data carriers with more than one data interface, then the dispensing apparatus may have more than one coding unit, in particular, one coding unit for each data interface of the data carrier, whereby a functional test may preferably be performed for each data interface of the data carrier.

The reading of data can be initiated and, in particular, controlled by a detection module. The data read can be made available to the detection module. The detection module can be configured to check the correctness of the data read. It goes without saying that the functionality can also be checked by other tests. For example, it can only be checked whether a communication link can be established between the card-shaped data carrier and the detection unit.

The subsequent sorting of the card-shaped data carrier is carried out, in particular, depending on the result of the functional test. If, for example, the data could be read without errors, a positive functional test is provided or an error-free card-shaped data carrier is provided. If, for example, an error occurred while reading the data, a negative function test or an incorrect data carrier is provided.

In accordance with the application, a sorting unit is arranged which comprises at least one controllable drive means. The drive means is, in particular, a motor-based drive means. For example, the drive means may include at least one motor (e.g. an electrically driven stepper motor or a direct current motor) to drive at least one roller conveyor. In particular, it has been recognized that the drive means provided (anyway) for forwarding or further transporting can be configured in such a way that it carries out the sorting of the card-shaped data carriers as a function of the result of the functional tests.

For this purpose, the drive means according to the application can be operated, in particular, at at least two different speed levels in order to be able to forward card-shaped data carriers with a first and a second speed. In particular, the drive means is operated at a first speed level in order to forward a data carrier with a first speed upon detection of an error-free data carrier. The drive means is also operated at a second speed level, in particular, in order to forward a data carrier with a second speed upon detection of a defective data carrier.

Hereby the first speed level or first speed differs from the second speed level or second speed. For example, the first speed may be higher than the second speed.

By forwarding the card-shaped data carriers after the functional test with different speeds, a sorting of the data carriers can be achieved, in particular, a separation of error-free data carriers from defective data carriers.

Preferably, the card-shaped data carriers can be sorted into two different receptacles using the gravity. For this purpose, the receptacles may be separated by a separation module, in particular, a separation wall, on which the data carrier may temporarily rest when it is about to fall into one of the two receptacles. If the center of gravity of the data carrier is above the first receptacle, the data carrier will fall into the first receptacle; if the center of gravity is above the second receptacle, the data carrier will fall into the second recording. The separation module can therefore be a decision line, and the two possible speeds with which the data carrier is forwarded after the functional test determine, by their magnitude and/or direction, whether the data carrier falls into the first receptacle on a first side of the separation module, or into the second receptacle on a second side of the separation module.

In other words, a drive means may preferably eject error-free card-shaped data carriers with a higher speed into a remotely located first receptacle after the functional test, while the drive means may preferably push out defective data carriers with slow speed and drop them into a closely located second receptacle. The dispensing apparatus can sort the data carriers into preferably two receptacles by means of two different output speeds, the output direction, the mass inertia of the data carrier, the gravity and the geometric arrangement.

Once the geometry of the sorting unit, its positioning towards gravity and the type of data carrier (i.e. its mass) are determined, the sorting of the data carriers into one of the two receptacles is solely based on the on the current output speed, i.e. solely by setting the output speed a data carrier is sorted into a first receptacle or into a second receptacle. The direction of the movement of the data carriers is always the same along the same transport path, independent of the set speed. Depending on the set speed, only the respective end point (where the speed in the X direction is zero for the first time) of the movement of the data carriers varies in X direction. In other words: depending on the set speed, the data carrier is "thrown" differently far. In particular, a data carrier is ejected with a first speed over the opening of the second receptacle into the opening of the first receptacle and is pushed-out with a second speed to directly fall into the opening of the second receptacle.

According to a first embodiment of the dispensing apparatus in accordance with the application, the dispensing apparatus may comprise at least one first receptacle and at least one second receptacle. The second receptacle can be separated from the first receptacle by a separation module. The first receptacle and the second receptacle can be arranged in such a way that the error-free card-shaped data carrier is forwarded to the first receptacle and the defective data carrier is forwarded to the second receptacle.

A receptacle can be formed as a compartment or as a container with an open top side. A corresponding receptacle can comprise a circumferential side wall and a base. For example, the sidewall can be formed by several sub-sidewalls. The form and dimension of a receptacle can be adapted, in particular, to the form and dimension of the card-shaped data carrier to be output and/or to the first and second speeds at which error-free or defective data carriers are forwarded.

A separation module can be arranged to separate the first receptacle from the second receptacle. In other words, the first receptacle directly abuts to the second receptacle. In particular, a separation module may be a separation wall, a separating net or the like. A separation wall can be at least a part of the side wall, i.e. a sub-side wall, of the first receptacle and the second receptacle at the same time.

Preferably, all side walls of the first receptacle and second receptacle and the separation module can be made of the same material. The material can preferably be selected in such a way that spontaneous adherence of a card-shaped data carrier can be prevented as far as possible. The side walls of the first and second receptacles and the separating module can be made of corrugated sheet metal or the like.

The arrangement of the first receptacle and the second receptacle is adjusted to the first and second speeds, respectively the first speed and the second speed may be adjusted to the position of the first receptacle (in particular its opening) and the position of the second receptacle (in particular its opening). This means, in particular, that an error-free card-shaped data carrier is transported only into the first receptacle (and not into the second receptacle) by operating the drive means at a first speed level, and a defective data carrier is transported only into the second receptacle (and not into the first receptacle) by operating the drive means at a second speed level.

Card-shaped data carriers can be easily sorted and stored separately or further processed. The first receptacle may have a further opening through which the error-free data carrier can be removed by a user. Alternatively, the first receptacle may have a further opening through which the error-free data carrier is made available (gravity-driven) for a next processing step; for example, the error-free data carrier may fall into the dispensing tray of a vending machine and be removed there by a customer, or it may fall into a further processing unit of a machine etc. In the second receptacle, the defective data carriers can be (temporarily) collected.

In accordance with a preferred embodiment of a dispensing apparatus according to the application, the dispensing apparatus may comprise at least one transport path. A card-shaped data carrier to be dispensed can be transported via the transport path. For example, the data carrier can be provided at the beginning of the transport path. The at least one drive means can be configured to transport the data carrier along the transport path (from the beginning of the transport path to an end of the transport path) in an output direction. It goes without saying that at least one further drive means may be provided for the transport of the data carrier along the transport path.

Preferably, an antistatic unit may be installed in the transport path which at least reduces any electrostatic charging of the card-shaped data carrier and thus reduces the risk of the data carrier clinging to the side walls of the receptacle due to electrostatic charging during sorting into the first or second receptacle. In particular, at least one brush with bristles made of electrically conductive material can be used as an antistatic unit, which can be grounded accordingly to discharge electrical charges. For example, at least one brush with carbon fiber bristles can be used.

In the output direction, the second receptacle can connect to the transport path, in particular, to the end of the transport path. The first receptacle can connect to the second receptacle. In particular, the separation module described above can be arranged between the first receptacle and second receptacle. The coding unit and/or the detection unit, in particular, may be arranged at least partially along the transport path. For example, the previously described interface of the coding unit and/or the detection unit may be located at the transport path.

The drive means may be synchronized with the coding unit and/or detection unit. This means that the drive means transports the card-shaped data carrier to a coding position and/or a detection position. At this coding position and/or detection position, which may be a particular area, a communication link can be established between the interface of the data carrier and the interface of the coding unit and/or the detection unit, for example, to perform the coding process or the detection process. For example, the drive means may interrupt the movement of the data carrier at the coding position and/or at the detection position for at least a specified period of time. The at least one specified period of time may depend on the time required to complete the coding process and/or detection process. In the event that a coding process and a reading process require relative movement between the coding means and the data carrier, synchronization of the drive means with the coding means may mean that the data carrier is moved at a defined speed for writing and/or reading; this is the case, for example, for writing and reading magnetic strips.

It goes without saying that in the event of an unsuccessful attempt to establish a communication link, the detection unit assumes that the card-shaped data carrier is defective. Preferably the coding position can be identical with the detection position. It goes without saying that in the case of other variants of the application, the two positions may also differ.

For particularly reliable sorting and reliable operation, according to another embodiment, the distance in the output direction between the end of the transport path and the separating module (e.g. separation wall) can be smaller than the length of the card-shaped data carrier in the output direction. Preferably the distance can be between 55% and 95% of the length of the data carrier, especially preferred between 60% and 75% of the length of the data carrier.

The distance between the end of the transport path and the separation module (e.g. separation wall) can, in particular, be the length of the opening of the second receptacle. By the second receptacle (immediately) adjoining the end of the transport path and having a previously described length, the second and first speeds and the second and first speed levels, respectively, can be easily adjusted to the thus dimensioned and arranged opening of the second receptacle. In particular, a low second speed may be chosen in such a way as to reliably forward a defective card-shaped data carrier to the second receptacle.

Preferably, the first speed can be specified and set, respectively, in such a way that the error-free card-shaped data carrier is conveyed and transported, respectively, in particular ejected, beyond the separation module into the first receptacle. The first speed may have at least a value at which the data carrier is conveyed in the output direction to a (first) conveying end point, at which the length portion of the data carrier in the output direction on the side of the first receptacle is greater (e.g. greater than 55%) than the length portion of the data carrier on the side of the second receptacle (e.g. less than 45%). Due to its weight, the error-free data carrier will always fall into the first receptacle in this case. The (first) conveying end point is, in particular, a place along the path of the data carrier from which it will safely fall into the first receptacle.

Preferably the first speed can be between 0.4 and 0.6 m/s, preferably 0.5 m/s,

In order, for example, to prevent the error-free card-shaped data carrier from hitting the front side wall of the first receptacle and rebounding from the latter in the direction of the second receptacle, this side wall, in particular this sub-side wall, can be formed arcuately at least in the region in which a data carrier can hit it, in such a way that the side wall directs the impinging data carrier into the first receptacle. An arcuate sidewall can reliably prevent a data carrier from bouncing back from the front sidewall into the second receptacle. In particular, the upper (free) end of the front sub sidewall may be bent against the output direction.

Alternatively and preferably additionally, the second speed can be specified and set, respectively, in such a way that the defective card-shaped data carrier is at least not conveyed beyond the separation module. Preferably, the second speed may be predetermined such that the defective card-shaped data carrier is conveyed in the output direction to a (second) conveying endpoint. At this conveying endpoint, the length portion of the data carrier in the output direction on the side of the second receptacle may be greater (e.g. between 55% and 80%) than the length portion of the data carrier on the side of the first receptacle (e.g. between 20% and 45%). In this case, the defective data carrier always falls into the second receptacle due to its weight. The (second) conveying endpoint is, in particular, a place along the path of the data carrier from which it will safely fall into the second receptacle. Due to the lower second speed, the data carrier may rest on the separation module between the first and second receptacle, in particular, when it reaches the (second) conveying endpoint. The (second) conveying end point is thus, in particular, the location along the path of the data carrier from which the data carrier falls backwards into the second receptacle.

Preferably the second speed can be between 0.04 and 0.06 m/s, especially 0.05 m/s.

As already described, a separation module, like a separation wall, is arranged between the first receptacle and the second receptacle. In this embodiment, the length portion of the length of the card-shaped data carrier in the output direction on the side of the second receptacle can be at least greater than the length portion of the length of the data carrier in the output direction on the side of the first receptacle in the conveying end point seen from the separation module.

At the conveying end point, the card-shaped data carrier contacts in particular the separation module, in particular, the upper end or the upper edge of the separation module (e.g. a separation wall). This point can also be called a resting point. At this point of contact, the gravity on the side of the second receptacle is greater, in particular, if the data carrier has been forwarded with the second speed. Alternatively or additionally, at this point of contact, gravity is greater on the side of the first receptacle if the data carrier has been forwarded with the first speed. Preferably, it may be provided that the first speed and the dimension of the separation module are predetermined such that the upper end and the upper edge of the separation module, respectively, are not contacted by the data carrier when the data carrier is forwarded at the first speed. This can further improve the reliability of the sorting process.

In order to reduce the required installation space and in particular the transport distance, in accordance with a further embodiment of the dispensing apparatus according to the application, the drive means can be configured for transporting the card-shaped data carriers in the output direction and for transporting the data carriers in the direction opposite to the output direction. For example, a motor of the drive means can be operated "backwards" and "forwards". If an error-free data carrier is detected, the drive means can be configured in such a way that the data carrier is first transported backwards a certain distance in the opposite direction to the output direction and is then accelerated to the first speed in the output direction. In particular, this can increase the available distance of acceleration. In a simple manner, at the first speed level, the drive means can accelerate the data carriers to a first speed sufficient to convey the error-free data carrier (beyond the separation module) into the first receptacle, in particular to eject it.

Preferably, the transport path may comprise at least one guide module, in particular, in the form of a groove-shaped guide module. The at least one guide module can be configured to guide the card-shaped data carrier along the transport path. Preferably, a plurality of guide modules can be provided. The height of the groove of a guide module can correspond to the thickness of the data carrier to be transported.

Furthermore, according to a further embodiment of the dispensing apparatus, the transport path may comprise at least one position sensor, preferably at least two position sensors. The at least one position sensor can be configured to detect the position of the card-shaped data carrier on the transport path. The position sensor can preferably be an optical sensor (e.g. a light barrier). In particular, the transporting or forwarding of a data carrier by the drive means can be conducted depending on the position data of the data carrier detected by the at least one position sensor.

According to a further embodiment, the height of the end of the separation module (e.g. a separation wall) may be less than the height of the end of the transport path. This simplifies the forwarding, in particular, the ejecting of the error-free card-shaped data carrier beyond the separation module into the first receptacle and ensures sufficient reliability.

As already described, a card-shaped data carrier can be provided at a beginning of the transport path and then be transported onwards by the at least one drive means in the output direction. Preferably, the dispensing apparatus may include at least one feed unit. The feed unit can be configured to provide the data carrier. The feed unit may include a separating means. The separating means can be configured to separate the data carriers that can be stacked (on top of each other) in a housing of the feed unit.

The separating means may include at least one motor for driving a separating element. The separating element may be at least one cam mounted on a shaft, a rotatable disc with a driver or the like. The motor can be configured to drive the separating element in such a way that, for example, when a card-shaped data carrier is requested from a control unit, exactly one data carrier is forwarded to the transport path. In particular, the height of the output gap of the feed unit through which the data carrier is led out of the feed unit can correspond to the thickness of the data carrier; this means, in particular, that the height of the output gap is greater than the thickness of one data carrier and smaller than the thickness of two data carriers, so that exactly one data carrier is separated and forwarded to the transport path.

The separating means may preferably at least support the transport of the card-shaped data carrier over at least part of the transport path.

Particularly preferably, the separating means may be a stepwise formed separating means, comprising at least one stepwise formed abutment surface with at least one step, preferably a plurality of steps. This allows the individual feeding of card-shaped data carriers to the transport path to be ensured in a reliable manner.

A further aspect of the application is a dispensing device, in particular, a ticket vending machine, comprising at least one previously described dispensing apparatus.

Another aspect of the application is a method for operating a dispensing apparatus, in particular, a dispensing apparatus described above. The method comprises:

providing at least one card-shaped data carrier, encoding of the provided data carrier with at least one data set, detecting the functionality of the encoded data carrier, forwarding the data carrier with a first speed upon detection of an error-free data carrier; and forwarding the data carrier with a second speed upon detection of a defective data carrier, wherein the first speed is different from the second speed.

The providing of at least one card-shaped data carrier comprises, in particular, the providing of exactly one card-shaped data carrier. The forwarding of the error-free card-shaped data carrier with a first speed preferably comprises the forwarding, in particular, the ejecting, of the data carrier into a first receptacle (e.g. as described above). In addition, the forwarding of the defective data carrier with a second speed, in particular, comprises the forwarding, in particular, the pushing out, of the data carrier to a second receptacle (e.g. as described above). Card-shaped data carriers can easily be sorted according to their functionality.

A module, unit and/or means referred to in this application may be formed at least in part by software elements and/or at least in part by hardware elements.

The features of the dispensing apparatuses, dispensing devices and methods can be freely combined with each other. In particular, features of the description and/or of the dependent claims, even with complete or partial circumvention of features of the independent claims, may be inventive in their own right or freely combined with each other.

DETAILED DESCRIPTION OF SPECIFIC EMBODIMENTS

In the following, the same reference signs are used for the same elements.

The term "card", which is used in the following examples for linguistic simplification, is synonymous with the "card-shaped data carrier" described above.

In the figures a right-angled, three-dimensional coordinate system is used, the axes of which have the following meanings:

X The dispensing apparatus transports the cards in the x-direction, whereby the output direction is in the positive x-direction.

In the following, the "length" of an object means its expansion in the x-direction.

Locations that are described as "front", "front . . . " or the like have a larger x-value within the coordinate system than locations that are described as "back", "behind . . . " or the like.

Movements called "ahead", "forwards" or the like, run in the direction of increasing x-values. Movements called "back", "backwards" or the like move in the direction of decreasing x-values.

y The y-axis is perpendicular to the output direction and perpendicular to the direction of gravity.

In the following, the "width" of an object means its expansion in the y-direction.

Z The z-axis extends in the direction of gravity. Gravity acts in the negative z-direction.

In the following, the "height" or "thickness" of an object means its expansion in the z-direction.

Locations which are described as "up", "above" or similar have a larger z-value within the coordinate system than places which are described as "under", "below" or similar.

Movements called "up", "upward", "to the top" or the like move in the direction of increasing z-values. Movements that are called "down", "downwards", "to the bottom", "falling" or the like move in the direction of declining z-values.

Figure 1:
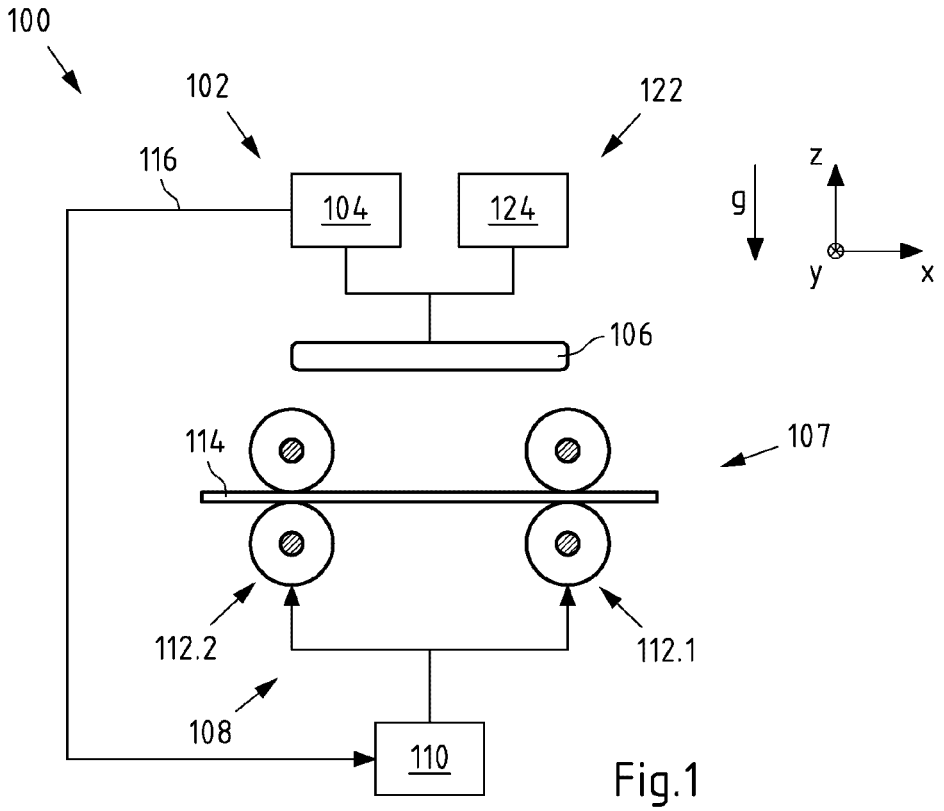
FIG. 1 a schematic view of an embodiment of a dispensing apparatus in accordance with the present application, FIG. 2 a schematic view of another embodiment of a dispensing apparatus in accordance with the present application, FIG. 3 a schematic view of another embodiment of a dispensing apparatus in accordance with the present application, FIG. 4 a schematic view of an embodiment of a separating element in accordance with the present application, FIG. 5 a schematic view of an embodiment of a separating element in accordance with the present application, and FIG. 6 a diagram of an embodiment of a method in accordance with the present application.

FIG. 1 shows a schematic view of an embodiment of a dispensing apparatus 100 in accordance with the present application. The dispensing apparatus 100 may, for example, be part of a dispensing device (e.g. a ticket vending machine).

The dispensing apparatus 100 comprises at least one coding unit 122 and at least one detection unit 102. The coding unit 122 is formed by a coding module 104 and a contactless interface 106 in the form of an antenna 106. The detection unit 102 is formed by a detection module 124 and the antenna 106. In other words, the antenna 106 can be used for a coding process and a detection process. It shall be understood that, according to other variants of the application, two separate interfaces and/or other types of interfaces may also be provided. All what is required is that at least one interface can be used to code and/or read a card 114 to be dispensed.

Further, the dispensing apparatus 100 comprises a sorting unit 107 comprising at least one drive means 108. In particular, the sorting unit 107 is formed by the drive means 108. The drive means 108 comprises at least one controllable motor 110 (for instance an electrically operated stepper motor or direct current motor) and two roller or conveyor modules 112.1, 112.2 which can be driven by the motor 110.

The drive means 108 is configured to transport or forward a card 114. The card 114 is transported or forwarded along the x-axis of the drawn coordinate system. The drive means 108 may be operated at least at a first speed level and a second speed level. If the drive means 108 is operated at the first speed level, the card 114 is forwarded with a corresponding first speed. When the drive means 108 is operated at the second speed level, the card 114 is forwarded with a corresponding second speed.

The card 114 can comprise at least one (not shown) memory module and one (not shown) interface (e.g. an antenna). The interface of the card 114 corresponds in particular to the interface 106. In other words, a communication link can be established between said interfaces, e.g. to write data to the card (e.g. to the memory module of card 114) or to read data from the card (e.g. from the memory module of the card 114).

The coding unit 122 can first encode or write at least one data set to a provided card 114 at the shown coding position of the card 114. For example, based on a provided data set, the coding module 104 can generate a coding signal and cause its transmission by the antenna 106. The transmitted data set can be received by the antenna of the card 114 and extracted and stored by a (not shown) data processing device on the card 114.

Furthermore, the detection unit 122 can detect the functionality of an encoded card 114 in a detection position of the card 114. The detection position can be the same as the coding position. In particular, the detection unit 122 may perform at least one functional test to detect the functionality of the card 114.

For example, the detection unit 122 can detect whether data can be read from the card 114. In addition, in particular, the detection module 124 can check the correctness of the data read by comparing the data previously written to the card 114 with the data read back from the card 114. It shall be understood that according to other variants of the application, other detection processes can be performed to detect the functionality of the card 114. The detection process can, in particular, be controlled by the detection module 124.

The drive means 108 may include a control element (not shown). The detection result (e.g. error-free card 114 or defective card 114) can be provided to the control element of the drive means 108 via a communication link. Upon detection of an error-free card 114, the drive means 108 is configured such that the card 114 is forwarded with a first speed. Upon detection of a defective card 114, the drive means 108 is configured such that the card 114 is forwarded with a second speed. In particular, the control element can control the at least one motor 110 accordingly. This makes it easy to sort cards 114. Switch mechanisms or the like are not required.

In other variants of the application, the dispensing apparatus may comprise at least one control unit configured to control at least part of the components (e.g. the coding unit, the detection unit and/or the drive means) of the dispensing apparatus. For example, a control unit may comprise a processor, memory, interfaces, software with instructions etc.

Figure 2:
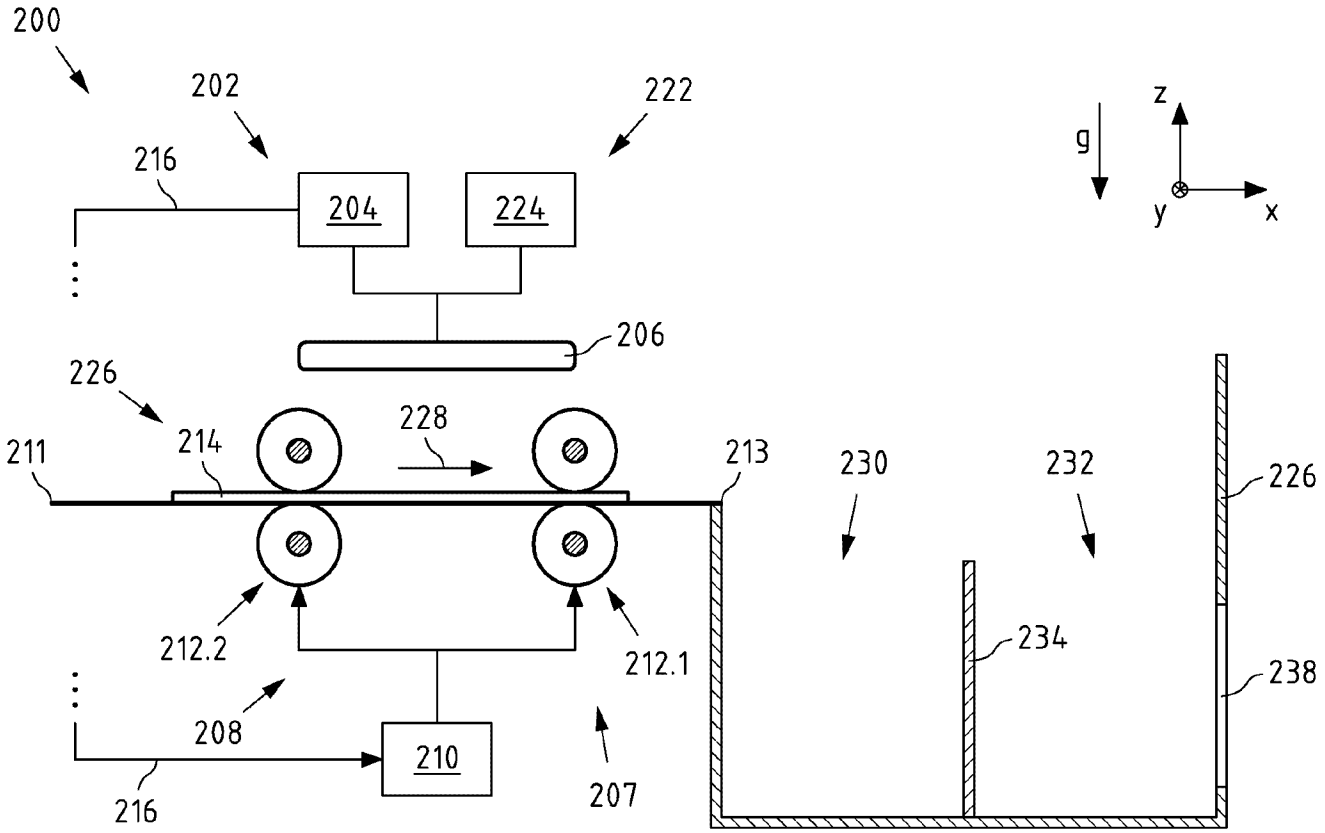

FIG. 2 shows a schematic view of another embodiment of a dispensing apparatus 200 in accordance with the present application. In order to avoid repetitions, only the differences to the example in FIG. 1 are described below. For the other components of the dispensing apparatus 200, please refer, in particular, to the explanations above.

The dispensing apparatus 200 comprises a transport path 226 with a beginning 211 and an end 213. A card 214 to be dispensed can be provided at the beginning 211 and, for example, be transported along the transport path 226 by a (previously described) drive means 208. The arrow with the reference sign 228 indicates the output direction 228 for cards 214 to be output; in the drawn coordinate system the output direction 228 corresponds to the positive x-direction. For example, the provided card 214 may first be conveyed to the coding position described above.

In addition, the dispensing apparatus 200 comprises a first receptacle 232 and a second receptacle 230. A receptacle 230, 232 is formed as a compartment or container with a circumferential side wall, a base and a receptacle opening. The first receptacle 232 is separated from the second receptacle 230 by a separation module 234 in the form of a separation wall 234. In addition, the second receptacle 230 is open at the base, so that a card 214, which is fed into the second receptacle 230, falls through the opening to be provided for a next machining step. For example, below the second receptacle 230 there may be a (non-shown) dispensing tray of a vending machine from which a customer can manually remove the card 214, or the card 214 may be fed to a further machine processing step.

Seen in output direction 228, the second receptacle 230 is located directly at the end 213 of the transport path 226. The second receptacle 230 is directly connected to the first receptacle 232.

The second speed is, in particular, adjusted to the arrangement of the first receptacle 232 and the second receptacle 230. Furthermore, the first speed is, in particular, adjusted to the arrangement of the first receptacle 232 and the second receptacle 230. This means, in particular, that an error-free card 214 is transported, in particular, ejected, only into the first receptacle 232 (and not into the second receptacle 230) by operating the drive means 208 at a first speed level, and a defective card 214 is transported, in particular, ejected, only into the second receptacle 230 (and not into the first receptacle 232), in particular, by operating the drive means 208 at a second speed level.

In this embodiment, the first speed can be greater than the second speed to forward a card 214 beyond the separation wall 234 along a trajectory parabola to the first receptacle 232, in particular, to eject it. The second speed may be predetermined such that the card 214 is not conveyed beyond the separation wall 234 to pass the card 214 to the second receptacle 230. A sorting of cards 214 can be carried out in a simple and reliable way.

Figure 3:
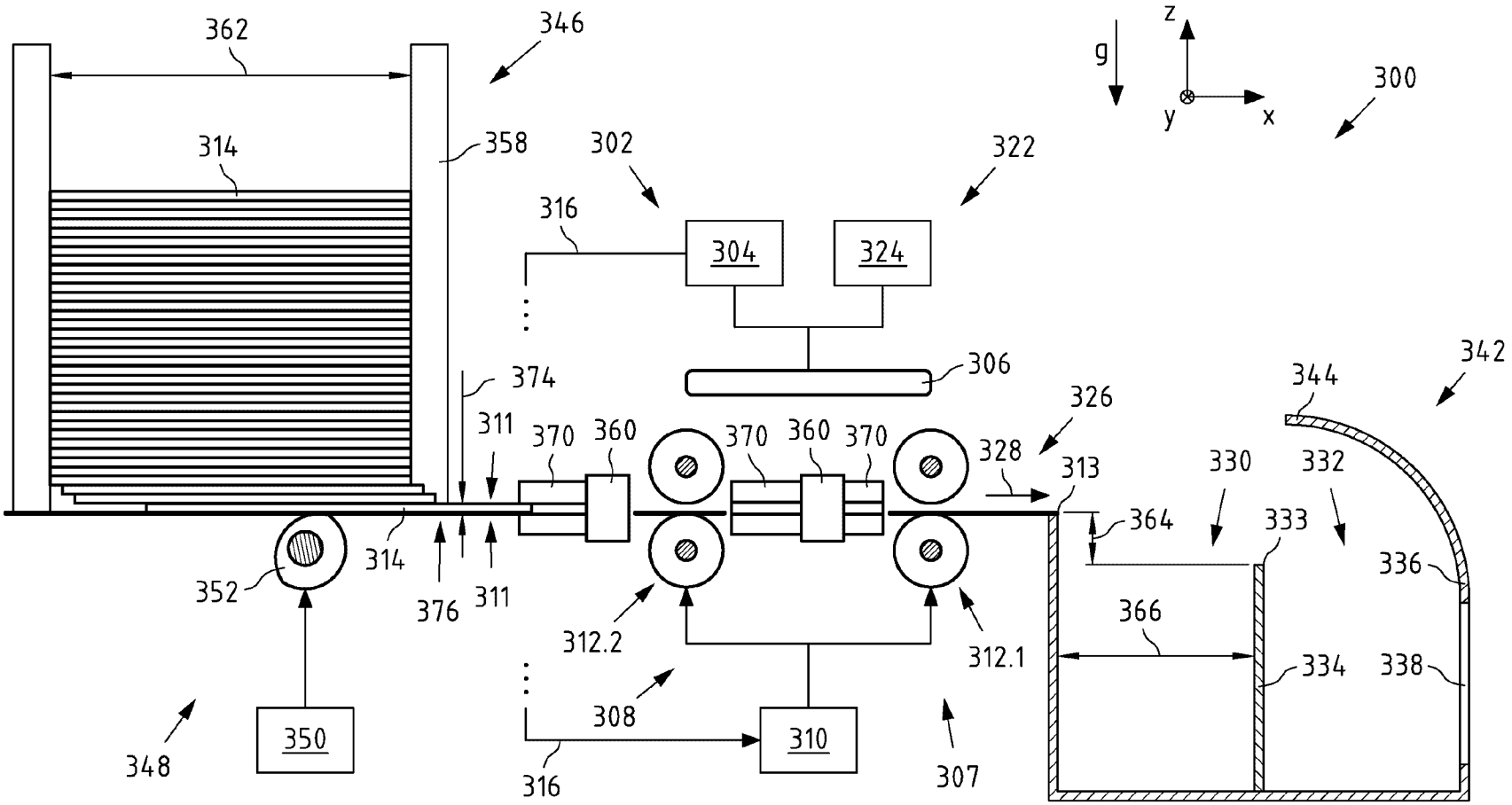

FIG. 3 shows a schematic view of another embodiment of a dispensing apparatus 300 according to the present application. In order to avoid repetitions, only the differences to the embodiments according to FIGS. 1 and 2 are described below. For the other components of the dispensing apparatus 300, please refer in particular to the explanations above.

In the embodiment shown, the dispensing apparatus 300 comprises a feed unit 346 configured to provide cards 314 at a beginning 311 of the transport path 326. In a housing 358 of the feed unit 346, a plurality of cards 314 can be stacked on top of each other in the z-direction, thus under the influence of gravity.

To always provide exactly one card 314 from the plurality of stacked cards 314, the feed unit 346 comprises at least one separating means 348. The separating means 348 may comprise at least one motor 350 and at least one separating element 352. For example, the at least one separating element 352 is a cam element 352 arranged on a rotation shaft and driven by the motor 350.

The present cam mechanism 352 is, in particular, configured to carry out a separation of the stacked cards 314 in cooperation with a stop surface 376, which is preferably formed in steps, and to provide exactly one separated card 314. The height 374 of the exit gap of the feed unit 346 at the beginning of the transport section 326 can correspond to the thickness of the cards 314. In particular, the height of the output gap can be greater than the thickness of one data carrier and smaller than the thickness of two data carriers.

For a defined forwarding of the cards 314, a plurality of guide modules 370 is arranged in this embodiment. In particular, a guide module 370 may comprise a groove or a gap to guide a card 314. In particular, the arrangement of the guide modules 370 and the conveyor modules 312 ensures that a card 314 to be output receives a defined output direction.

Further, two position sensors 360 are presently provided. Preferably, optical sensors 360, for example light barriers 360, can be provided. In particular, the position of a transported card 314 can be detected with the light barriers 360. The position data can be used to control the motor 350 and/or the motor 310.

To safely dispense a card 314, it is advantageous if a driven conveyor module 312.1 is the last element along the transport path 326 that carries a card to be output. This is particularly advantageous if the card 314 is to be pushed out at the (low) second speed: if the last guide element is actively driven, it can be safely assumed that the card 314 has actually left the transport path 326 and is on its way to fall into the desired first receptacle 330 or the desired second receptacle 332.

To safely dispense a card 314, in particular, to safely drop it into the second receptacle 330, it is advantageous that the top edge 367 of the rearmost sidewall in the x-direction is left behind the line of the foremost extension 312.1.1. of the conveyor module 312.1. This arrangement ensures that there is no step between the end 313 of the transport path 326 and the rear wall of the second receptacle 330, on which a card 314, which is to fall into the second receptacle 330, could get stuck.

As has already been written, a (central) control unit can be provided according to other variants of the application in order to control the components (e.g. motor 350, drive means 308, coding device 302, detection device 322 etc.). This can be done, for example, depending on captured position data and/or detection results.

In addition, a first receptacle 332 and a second receptacle 330 are provided, which will be connected to the end of 313 of the transport path 326. The distance 366 between the end 313 of the transport path 326 and the separation module 334 is preferably less than the length 362 of the card 314. The distance 366 corresponds, in particular, to the length of the receptacle opening of the second receptacle 330.

Furthermore, a height difference 364 is provided between the end 313 of the transport path 326 and the upper end 333 of the separation module 334, preferably a separation wall 334. This makes it possible to improve the reliability of forwarding, in particular, ejecting an error-free card 314 into the first receptacle 332 beyond the separation module 334. The height difference 364 is preferably between 25% and 30% of the length of a card 314.

In order to provide reliable routing of an error-free card 314 hitting the front sub sidewall 336 into the first receptacle 332, this sidewall 336 is formed arched in the upper end area 342. In particular, a bending of the upper (free) end 344 of the side wall 336 opposite to the output direction 328 is provided. In particular, this can prevent an undesired rebound of a card 314.

The diagonal 369 of the second receptacle 330 can correspond at least to the length of the cards 314 in order to be able to collect several defective cards 314 in the second receptacle 330 without changing the function-determining geometry of the dispensing apparatus 300, in particular, the distance 364, by collecting cards.

It shall be understood that the width of the entire dispensing apparatus 300 shown and of all the units used in it (i.e. their respective extension in the Y direction) is suitable for the width of the cards 314. In particular, the housing 358 of the feed unit, the stop surface 376, the position sensors 360, the guide modules 370 and the transport path 326 may have a usable width at least equal to the width of the cards 314, preferably exactly equal to the width of the cards 314. The width of the first receptacle 332 and the second receptacle 330 may be at least equal to the width of the cards 314.

Figure 4:
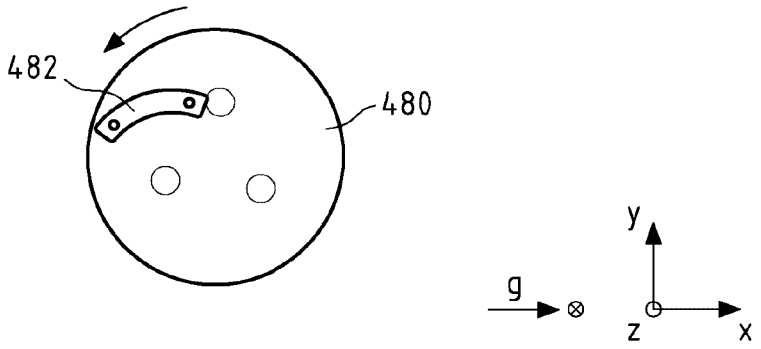
Figure 5:
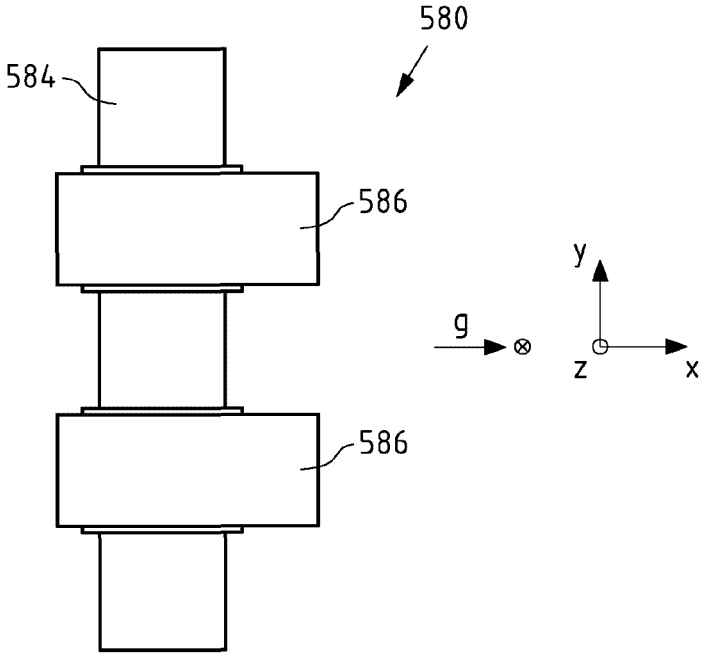

FIGS. 4 and 5 show schematic top views of embodiments of separation elements 480, 580 according to the application.

FIG. 4 shows a disc-shaped separating element 480 with a driver 482. The separating element 480 can be installed at the level of the card transport in the rear end of the feed unit 346. The separating element can be rotated around the z-axis. For the removal of exactly one (namely the lowest) card 314 from the card stack in the feed unit 346, the separating element rotates exactly one rotation, and the driver 482 pushes the lowest card 314 from the card stack to the beginning of the transport path 326 by positive locking. The driver 482 can, in particular, be fastened on the upper side of the disc-shaped separating element 480, for example glued, soldered, welded, screwed or inserted.

FIG. 5 shows another embodiment of a separation element 580. With this separating element 580 at least one cam 586 is arranged on a shaft 584, wherein it is understood that two or more cams can also be arranged on the shaft 584. The separating element 580 corresponds to the separating element 352 in FIG. 3. The separating element 580 is arranged below the plane of the card transport and can be rotated around the Y-axis. In particular, the separating element 580 is arranged in such a way that the at least one cam 586 contacts the lowest card 314 of the card stack in the feed unit 346 during one rotation of the separating element 580 and, by frictional engagement between cam 586 and card 314, moves at least the lowest card 314 of the card stack in the direction of the beginning of the transport path 326. Due to further friction between the lowest card 314 and the cards above it, it may happen that more than one card 314 is initially moved in the direction of the beginning of the transport path 326 during one rotation of the shaft 584. However, the stop surface 376 allows exactly one card 314 (namely the lowest card) to pass in the direction of the transport path 326.

Figure 6:
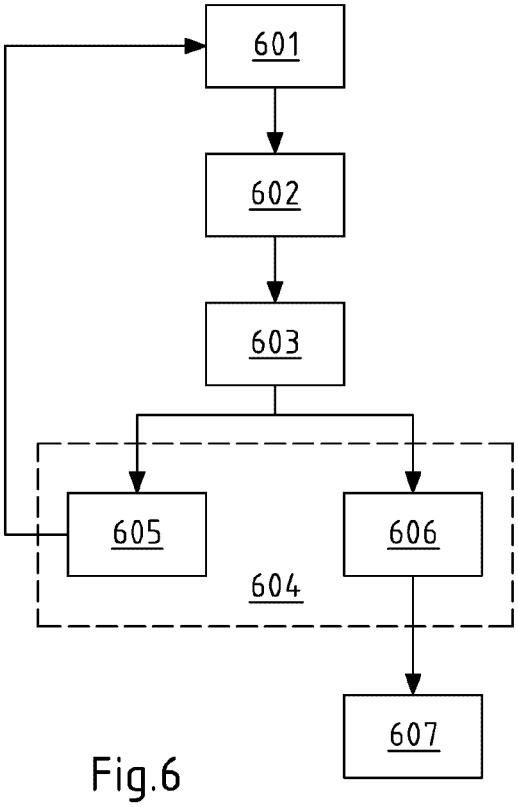

FIG. 6 shows a diagram of an embodiment of a method according to the present application to operate a dispensing apparatus. The method is explained in more detail below using the embodiment in FIG. 3 as an example. It goes without saying that the method can also be transferred to other output device variants of the present application.

In a first step 601, a card 314 is provided. Preferably the feed unit 346 provides exactly one card 314 at the beginning 311 of the transport path 326 by the separating means 348 conveying exactly one (in particular, only the lowest) card 314 in output direction 328. In particular, a provided card 314 can be transported to a coding position by the two motors 350, 310 and by the separating element 352 and the roller modules 312.1, 312.2, respectively. The reaching of the coding position by a card 314 can be detected, in particular, by the light barriers 360. When reaching the coding position, the motors 350, 310 can be stopped, for example.

In a next step 602, the provided card 314 is encoded with at least one data set. The at least one data set may include data required for the intended use of the card 314 or test data.

For example, the coding module 324 of a coding device 322 can generate a coding signal based on a provided data set and cause it to be transmitted by the antenna 306. The coding signal can be received by an interface of the card 314. For example, the coding signal may include instructions that cause the transmitted data set to be at least partially extracted from the coding signal and, in particular, stored in a memory module of the card 314.

After the coding process has been completed, a detection process can be performed in step 603. Since the same antenna 306 is preferably used for the detection process, it is not necessary to reposition the card 314 after the coding process.

During the detection process, the detection device 302 can check the functionality of the encoded card 314. For example, a functional test can be initiated and, in particular, controlled by the detection module 304. It is preferred to check whether at least some of the data stored on the card 314 can be identically read.

In a next step 604, the sorting process is carried out depending on the detection result. In particular, if a defective card 314 is detected, the method is continued with step 605 and if an error-free card 314 is detected, the method is continued with step 606.

In step 605, the motor 310 is started and, in particular, operated at a second speed level. At this speed level, the drive means 308 causes the card 314 to accelerate in the output direction 328 and to forward the card 314 with a second speed such that the card 314 can be conveyed (only) to the second receptacle 330.

In particular, the second speed may be predetermined such that a defective card 314 is conveyed to a second conveying endpoint at which, for example, approximately ⅔ of the length of the card 314 is over the second receptacle 330. At this moment the card 314 can be located on the end 333 of the separation module 334. The gravity then causes the card 314 to fall into the second receptacle 330.

In particular, step 605 can be configured so that the motor 310 (and thus the conveyor module 312.1) continues to run for the duration of a second run-on time after the last position sensor 360 has reported that the card 314 has left the transport path 326. If the card 314 is to be pushed into the second receptacle with the (small) second speed, this second run-on time can be between 0.2 and 0.6 seconds, preferably 0.4 seconds. After the second run-on time, the motor 310 can be switched off.

After forwarding a defective card 314 to the second receptacle 330, the next card 314 can be provided in step 601. Defective cards 314 can be temporarily collected in the second receptacle 330. When the receptacle capacity of the second receptacle 330 is reached and/or a certain period of time has elapsed, the second receptacle 330 can be emptied.

In particular, the second receptacle 330 may be equipped with a (non-shown) first sensor which measures the level of the second receptacle 330 and causes a signal to be emitted to a user and/or maintenance technician when the receptacle capacity of the second receptacle 330 is reached.

Alternatively, the dispensing apparatus 300 or a (non-shown) drive of the dispensing apparatus 300 may be configured to count the defective cards 314 forwarded into the second receptacle 330 and to notify a user and/or maintenance technician when the receptacle capacity of the second receptacle 330 is reached. For this purpose, the dispensing apparatus 300 may be equipped with a (not shown) second sensor which detects the removal of the second receptacle 330 for emptying and causes the counter reading to be reset when the receptacle 330 is removed.

Upon detection of an error-free card 314, in step 606 the drive means 308 can be operated at a first speed level such that the card 314 is forwarded to the first receptacle, in particular, ejected with a first speed. According to an example, the motor 310 can be operated as follows:

First, the motor 310 can be operated in a reverse direction at a third speed. In other words, the card 314 can first be returned against the output direction 328. This allows the available distance of acceleration to be extended in order to reach the first speed. The card 314 can be moved backwards by the drive means 308 in opposite output direction 328 up to a preset start position.

The reaching of the starting position can be detected by means of the light barriers 360. Upon detection of reaching the start position, the motor 310 can be set to the first speed level to accelerate the error-free card 314 in output direction 328 and forward it with a first speed greater than the second speed. By forwarding the card 314 with the first speed, the card 314 is conveyed, in particular, ejected beyond the separation module 334 into the first receptacle 332.

In particular, step 606 can be configured such that the motor 310 (and thus the conveyor module 312.1) continues to run for a first run-on time after the last position sensor 360 has reported that the card 314 has left the transport path 326. If the card 314 is to be forwarded to the first receptacle 332 with the (higher) first speed, in particular, ejected, this first run-on time can be between 0.05 and 0.2 seconds, preferably 0.1 seconds. After the first run-on time, the motor 310 can be switched off.

The error-free card 314 can then be made available for the next handling step.

For example, if a request to output another card 314 is entered by a user or a machine process, step 601 can be continued.

What is claimed is:

1. A dispensing apparatus for dispensing card-shaped data carriers, comprising:

at least one coding unit configured to encode a data carrier with at least one data set;

at least one detection unit configured to detect the functionality of the encoded data carrier; and at least one sorting unit, including at least one drive means configured to forward the data carrier along a transport path to an output, wherein the drive means is configured such that the data carrier is forwarded along the transport path with a first speed to the output upon detection of an error-free data carrier, and wherein the drive means is configured such that the data carrier is forwarded along the transport path with a second speed to the output upon detection of a defective data carrier, and wherein the first speed is different from the second speed.

2. The dispensing apparatus according to claim 1, further comprising at least one first receptacle and at least one second receptacle, wherein the second receptacle is separated from the first receptacle by a separation module, and the first receptacle and the second receptacle are arranged such that the error-free data carrier is forwarded into the first receptacle and the defective data carrier is forwarded into the second receptacle.

3. The dispensing apparatus according to claim 2, further comprising at least one transport path, wherein the drive means is configured to convey the data carrier along the transport path in an output direction, and wherein in the output direction the second receptacle connects to the transport path and the first receptacle connects to the second receptacle.

4. The dispensing apparatus according to claim 3, wherein the distance between an end of the transport path and the separation module in the output direction is smaller than the length of the data carrier.

5. The dispensing apparatus according to claim 3, wherein the first speed is predetermined such that the error-free data carrier is conveyed beyond the separation module into the first receptacle, and/or the second speed is predetermined such that the defective data carrier is not conveyed beyond the separation module.

6. The dispensing apparatus according to claim 5, wherein the second speed is predetermined such that the defective data carrier is conveyed in the output direction to a conveying endpoint, in which the length portion of the data carrier in the output direction on the side of the second receptacle is at least greater than the length portion of the data carrier on the side of the first receptacle.

7. The dispensing apparatus according to claim 3, wherein the drive means is configured to transport the data carrier in the output direction and opposite to the output direction; and the drive means is configured, upon detection of an error-free data carrier, in such a way that the data carrier is initially conveyed opposite to the output direction to a starting position and is then accelerated to the first speed in the output direction.

8. The dispensing apparatus according to claim 1 further comprising a feed unit configured to provide the data carrier, wherein the feed unit comprises a separating means configured to separate the data carriers stackable in a housing of the feed unit.

9. The dispensing apparatus according to claim 8, further comprising at least one transport path, and wherein the separating means comprises at least one motor for driving a separating element, wherein the motor for driving the separating element is configured such that a data carrier is forwarded onto the transport path.

10. A dispensing device, according to claim 1 wherein the card-shaped data carriers comprise tickets.

11. A method for operating a dispensing apparatus, comprising:

providing a plurality of card-shaped data carriers;

encoding each of the provided data carriers with at least one data set;

detecting the functionality of each of the encoded data carriers;

upon detection of an error-free data carrier, forwarding the error-free data carrier along a transport path at a first speed to an output; and upon detection of a defective data carrier, forwarding the defective data carrier along the transport path at a second speed to the output, wherein the first speed is different from the second speed.

* * * * *